US011643179B2

(12) United States Patent
Fraser

(10) Patent No.: US 11,643,179 B2
(45) Date of Patent: May 9, 2023

(54) SAIL

(71) Applicant: Mark Fraser, Brisbane (AU)

(72) Inventor: Mark Fraser, Brisbane (AU)

(73) Assignee: Mark Fraser, Brisbane (AU)

( * ) Notice: Subject to any disclaimer, the term of this patent is extended or adjusted under 35 U.S.C. 154(b) by 0 days.

(21) Appl. No.: 16/944,731

(22) Filed: Jul. 31, 2020

(65) Prior Publication Data

US 2020/0361585 A1 Nov. 19, 2020

Related U.S. Application Data

(63) Continuation of application No. PCT/IB2019/050765, filed on Jan. 31, 2019.

(30) Foreign Application Priority Data

Feb. 2, 2018 (NZ) ..... 739652

(51) Int. Cl.
*B63H 9/061* (2020.01)
*B63B 15/00* (2006.01)
*B63H 9/06* (2020.01)

(52) U.S. Cl.
CPC ..... *B63H 9/0635* (2020.02); *B63B 15/0083* (2013.01); *B63H 9/06* (2013.01)

(58) Field of Classification Search
CPC ..... B63H 9/06; B63H 9/061; B63H 9/0621; B63H 9/0635; B63H 9/08; B63B 15/0083
USPC ..... 114/114, 102.1, 102.22, 102.29, 102.32
See application file for complete search history.

(56) References Cited

U.S. PATENT DOCUMENTS

| | | | | |
|---|---|---|---|---|
| 3,532,067 | A | 10/1970 | Baker et al. | |
| 4,388,888 | A | 6/1983 | Gushurst, Jr. | |
| 5,263,429 | A | 11/1993 | Brinkmann | |
| 5,535,692 | A * | 7/1996 | Ezzy | B63H 8/20 114/109 |
| 6,112,688 | A * | 9/2000 | Jurriens | B63H 8/40 114/102.29 |
| 2017/0369139 | A1 | 12/2017 | Arendts | |

FOREIGN PATENT DOCUMENTS

| | | | |
|---|---|---|---|
| CN | 103702899 | A | 4/2014 |
| EP | 3096554 | A2 | 12/1983 |
| FR | 3029888 | A1 | 6/2016 |
| GB | 154556 | A | 9/1936 |
| GB | 506136 | A | 5/1939 |
| JP | 357158192 | A | 9/1982 |
| KR | 20140109054 | A | 9/2014 |
| SE | 1001108 | A1 | 5/2012 |
| WO | 2014053029 | A1 | 4/2014 |

(Continued)

OTHER PUBLICATIONS

Written Opinion of International Search Authority and International Search Report of International Application No. PCT/IB2019/050765.

(Continued)

*Primary Examiner* — Daniel V Venne
(74) *Attorney, Agent, or Firm* — JCIP; Joseph G. Chu; Jeremy I. Maynard

(57) ABSTRACT

A nestable wing sail having two or more sections. Where one section is configured to nest inside the first section, and can move out of the first section to extend the effective sail area of the wing sail.

18 Claims, 25 Drawing Sheets

(56) References Cited

FOREIGN PATENT DOCUMENTS

Figure 1:
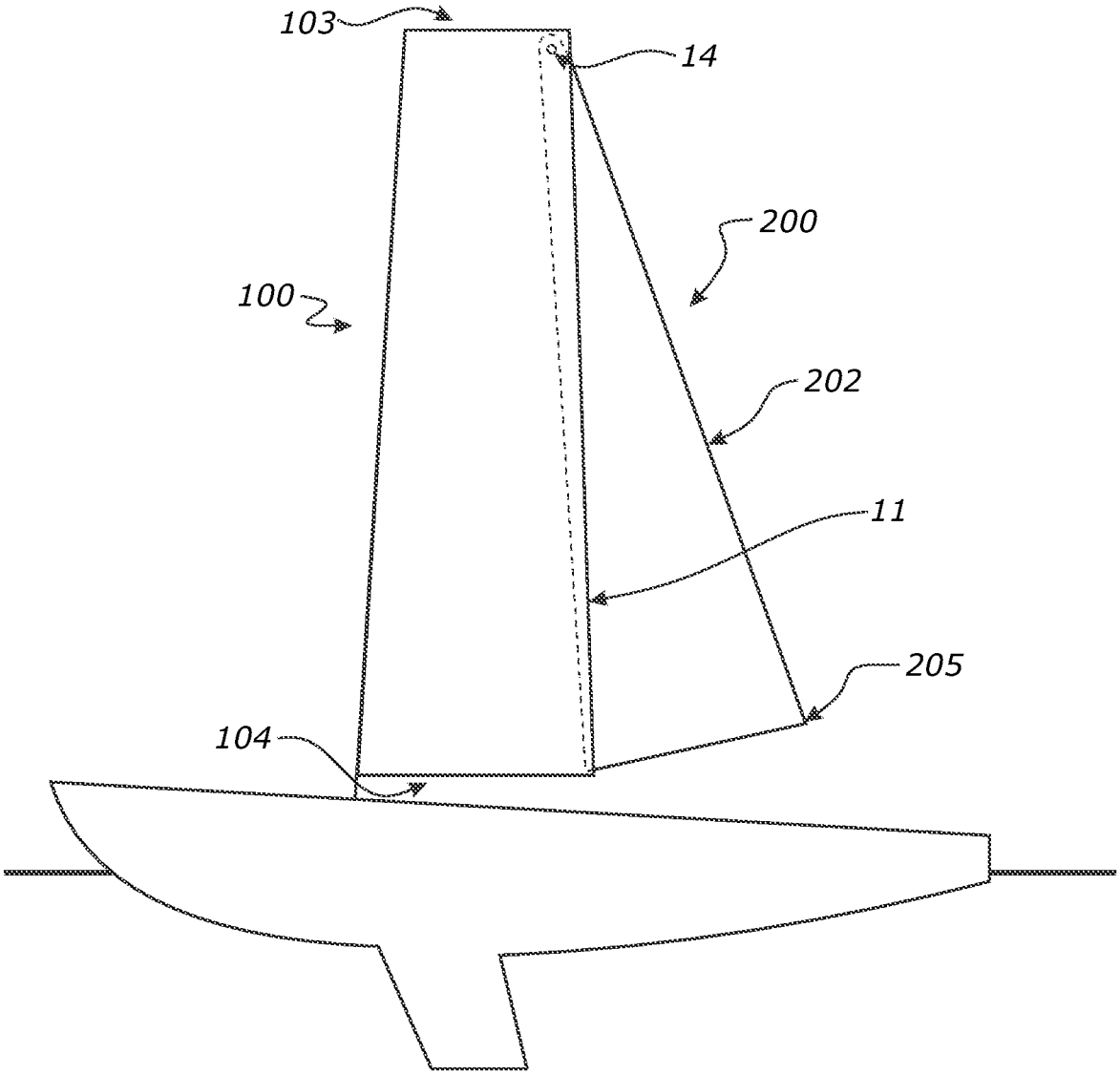

| | | | |
|---|---|---|---|
| WO | 2016076727 | A1 | 5/2016 |
| WO | 2019150289 | A1 | 8/2019 |

OTHER PUBLICATIONS

Written Opinion of International Search Authority dated Aug. 18, 2021 for International Application No. PCT/IB2021/056950.
Extended European Search Report dated Oct. 5, 2021 for European Application No. 19748026.2.
Chinese Office Action dated Mar. 14, 2022 for Chinese Application No. 201980013598.9.
Writen Opinion of the International Preliminary Examining Authority dated Jun. 7, 2022 for International Application No. PCT/IB2021/056950.
Writen Opinion of the International Preliminary Examining Authority dated Jun. 16, 2022 for International Application No. PCT/IB2021/056950.

* cited by examiner

SAIL

CROSS REFERENCE TO RELATED APPLICATIONS

This application is a continuation-in-part of and claims the right of priority from International Application PCT/IB2019/050765 having a filing date of Jan. 31, 2019, which claims the right of priority to New Zealand Patent Application NZ 739652 having a filing date of Feb. 2, 2018. The entirety of the contents of these respective applications are hereby incorporated by reference.

FIELD OF INVENTION

The present invention relates to a sail. More particularly but not exclusively it relates to a nestable wing sail that can change its surface area by partial extension and retraction in a fore aft direction.

BACKGROUND

Yachts may be desired to be sailed in a variety of wind conditions. A yacht is preferably able to be optimised for different conditions, in particular the sail area may need to be adjusted. Sails are generally of two basic constructions soft, fabric-shaped sails that are shell like, and wing sails which form a 3D cross section wing shape. Typically, a mainsail is reefed to decrease its sail area. A reef reduces the area of a sail, usually by folding or furling one edge of the sail in on itself. This may be achieved by retracting the mainsail downwards towards the boom, or forward towards the mast. Where the main sail is a wing sail, which is a solid sail that is not able to be reefed, it may be difficult to decrease the area of the sail. One way of achieving a different sail area is by changing the wing sail for a wing sail of a different area, this requires stepping and un-stepping wing sails.

It is an object of the present invention to provide a nestable wing sail that overcomes or at least partially ameliorates some of the abovementioned disadvantages or which at least provides the public with a useful choice.

STATEMENTS OF INVENTION

In a first aspect the present invention relates to a wing sail for a yacht, the wing sail comprising at least two sail sections, a primary section attached, integral with, or comprising a mast, and two skins forming an aerofoil surface forming the primary section, the primary section further comprising a leech at aft edges where the two skins converge, and a movable section configured to move between a first condition where the movable section is nested or partially nested within or at the leech of the primary section, and a second condition where the movable section extends from at least part of the leech intermediate the two skins.

In one embodiment, the primary section comprises a cavity defined by the sides, that can receive the movable section.

In one embodiment, the primary section and movable section comprise sail area that make up the sail area of the wing sail.

In a further aspect the present invention relates to a sail for a yacht, the sail comprising at least two sail sections, a primary section forming an aerofoil wing shape having a cavity intermediate port and starboard face sides which converge to form at the primary section a leech, and at least one movable section moveable between a first condition where the movable section is enveloped or partially enveloped in the cavity or otherwise stored at the leech, and a second condition where at least a portion of the movable section extends from the leech out of the cavity intermediate the primary section leech, where in the second condition the movable section adds to the sail area of the sail.

In one embodiment, the sides comprise aerofoil surfaces.

In one embodiment, the movable section is nested or partially nested within the primary section.

The below embodiments may relate to any of the above statements of invention.

In one embodiment, in the first condition the movable section is fully nested within the primary section so that the leech of the primary section forms the leech of the sail.

In one embodiment, in the second condition the aft edge of the movable section forms at least part of the leech of the sail.

In one embodiment, the movable section translates with respect to the primary section to move between the first and second condition.

In one embodiment, the movable section rotates with respect to the primary section to move between the first and second condition.

In one embodiment, the movable section rotates rotate about a pivot point near the head of the sail.

In one embodiment, the movable section rotate about a pivot point near the foot of the sail.

In one embodiment, the primary section comprises flexible regions at its leech that is configured to flex to allow the movable section to pass intermediate the sides of the primary section through the primary section leech.

In one embodiment, the movable section is a soft sail.

In one embodiment, the movable section is an aerofoil wing sail.

In one embodiment, the aft edges of a sail section form a leech when not spread laterally apart by an adjacent sail section.

In one embodiment, the aft edges of a sail section overlap with the adjacent section to form a join comprising a substantially continuous surface between the sections adjacent each other when spread apart by the adjacent sail section.

In one embodiment, the joins bridge adjacent sections so as to form a substantially continuous surface between adjacent sail sections.

In one embodiment, the sail comprises two or more movable sections.

In one embodiment, the sail comprises the movable section and a second movable section.

In one embodiment, the second movable section nests within the movable section, in a similar configuration to how the movable section nests within the primary section.

In one embodiment, at least a portion of the movable section leech is configured to allow at least a portion of the second movable section to pass therethrough.

In one embodiment, each sail section has a sail area greater than the sail section aft of it.

In one embodiment, the sail comprises a mechanism to actuate the movable sections between their first and second conditions.

In a further aspect the present invention relates to a reconfigurable wing sail for a yacht, the wing sail having an adjustable effective sail area by extending or retracting a nested wing sail section through the leech of a primary wing sail section.

In one embodiment, the nested wing sail section nests within a cavity of the primary wing sail section.

In one embodiment, the area towards and along the leech of the primary wing sail section is flexible to allow the nested wing sail to pass therethrough.

In one embodiment, there are multiple nested wing sail sections within the primary wing sail section configured to extend the effective sail area of the sail.

In one embodiment, the primary wing sail section is attached to a yacht.

In one embodiment, the primary wing sail section comprises a mast.

In a further aspect the present invention relates to a yacht comprising the sail described above.

In a further aspect the present invention relates to a yacht comprising a sail, the sail comprising at least two sail sections and a primary section having a cavity intermediate port and starboard face sides which converge to form at a leech or head of the primary section, and at least two movable sections moveable between a first condition where the movable sections are enveloped or partially enveloped in the cavity, and a second condition where at least a portion of at least one movable section extends from the head or leech out of the cavity of the primary section, where in the second condition the movable section adds to the effective sail area of the sail.

In one embodiment, the moveable sections move vertically out of the head primary section that acts as boom, or from move out from the leech of a mast or wing sail.

In one embodiment, the head and/or leech of said primary section and/or one or moveable sections is flexible to allow moveable sections to pass through.

In one embodiment, the primary section forms at least part of an aerofoil wing shape in either one or both of the first and second condition.

In one embodiment, the yacht comprises mechanisms to actuate the moving of the one or more movable sections.

In one embodiment, the yacht extends its effect sail area by moving a moveable section at least partially out of the primary section.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

FIGURE DESCRIPTIONS

The invention will now be described by way of example only and with reference to the drawings in which:

FIG. 1: shows a side schematic view of a nestable wing sail in an extended condition.

Figure 2A:
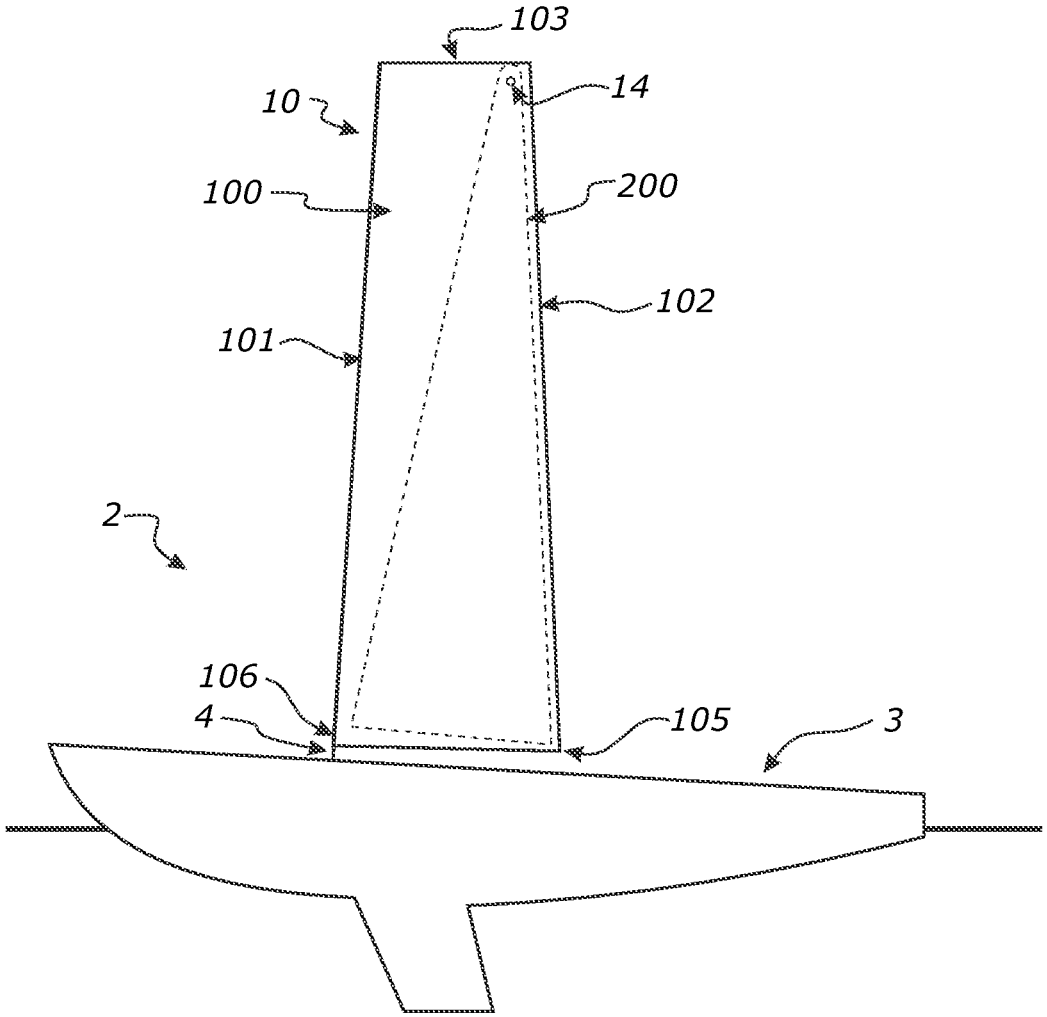

FIG. 2A: shows a side schematic view of a nestable wing sail in a retracted condition.

Figure 2B:
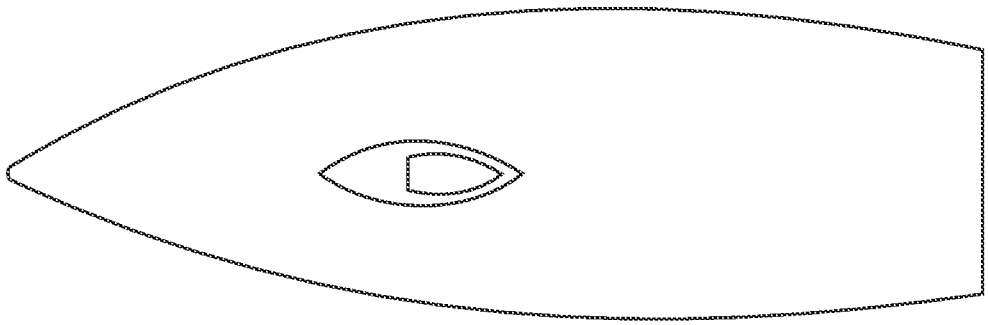

FIG. 2B: shows a top schematic view of FIG. 2A.

Figure 3A:
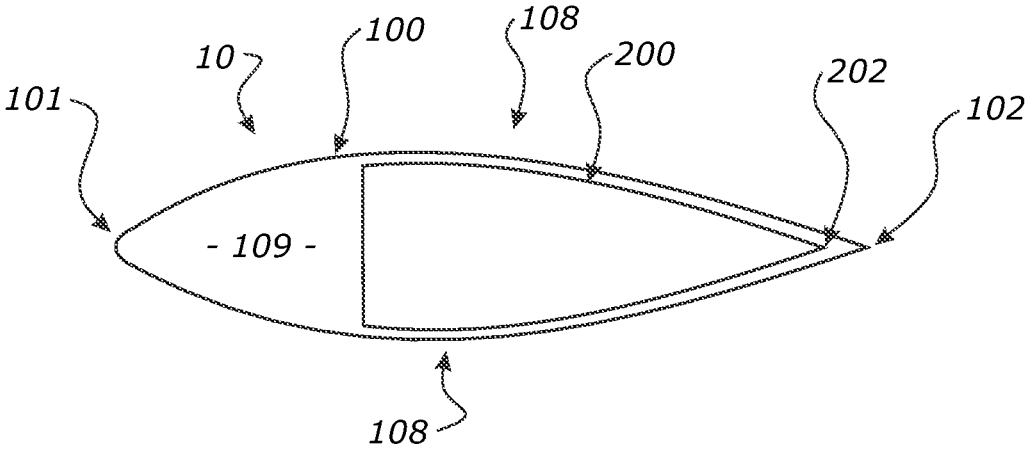

FIG. 3A: shows a top schematic view of a wing sail in a retracted condition.

Figure 3B:
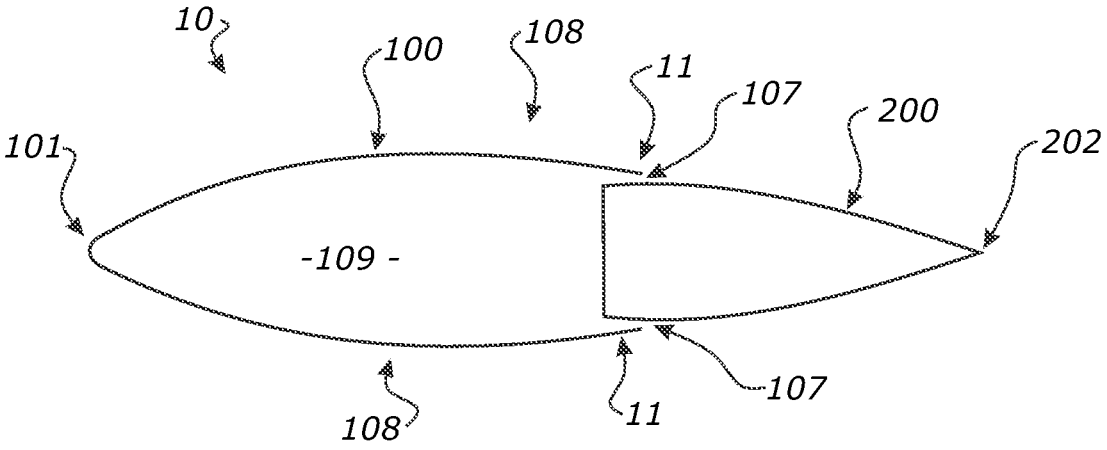

FIG. 3B: shows a top schematic view of a wing sail in an extended condition.

Figure 4A:
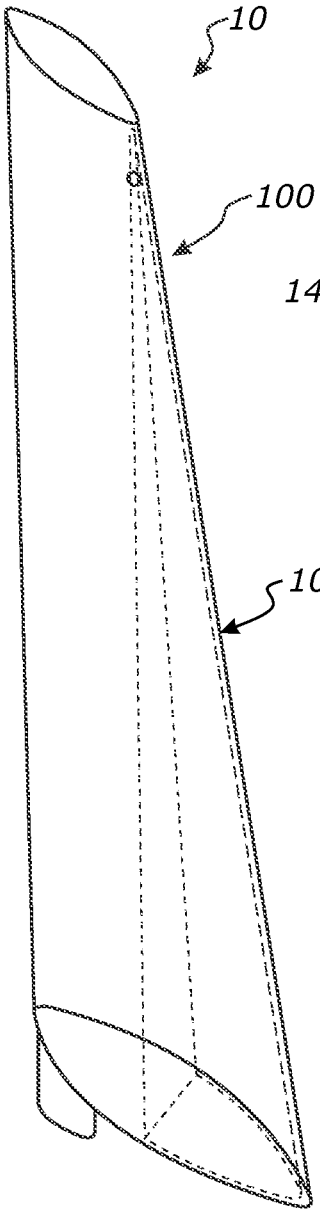

FIG. 4A: shows a rear perspective view of a wing sail in a retracted condition.

Figure 4B:
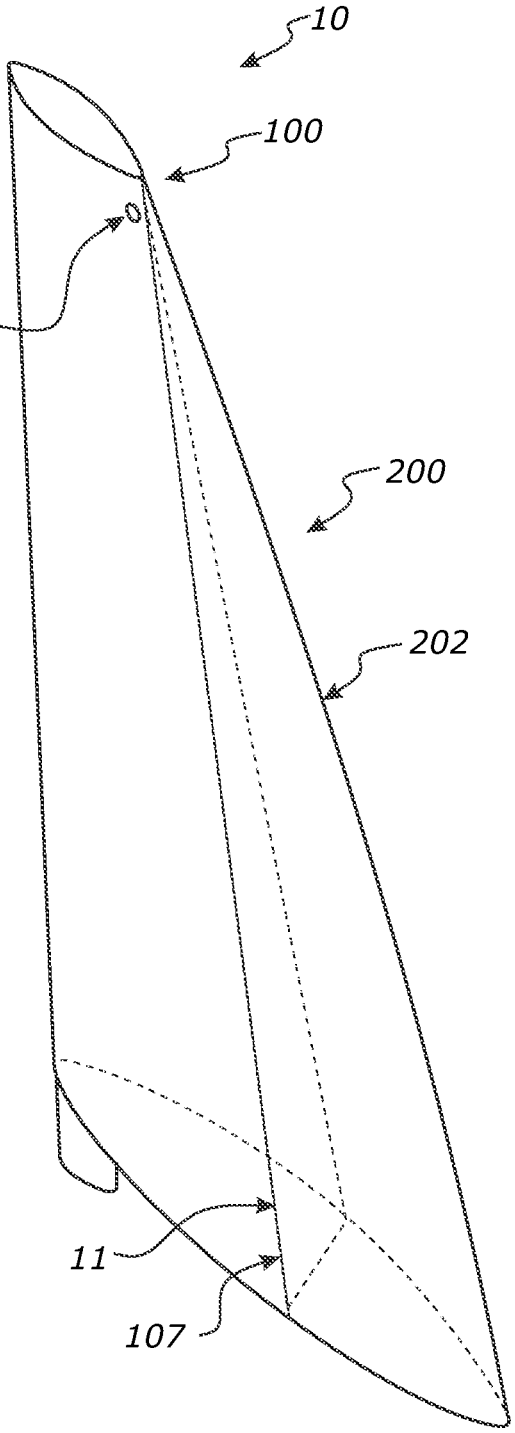

FIG. 4B: shows a rear perspective view of a wing sail in an extended condition.

Figure 5:
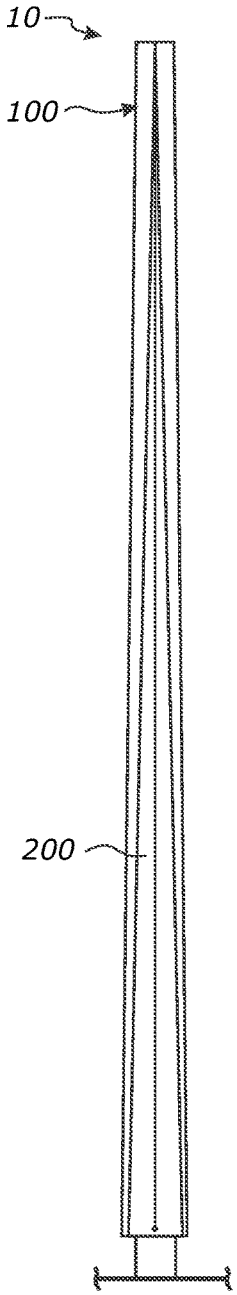

FIG. 5: shows a rear view of a wing sail in an extended position.

Figure 6:
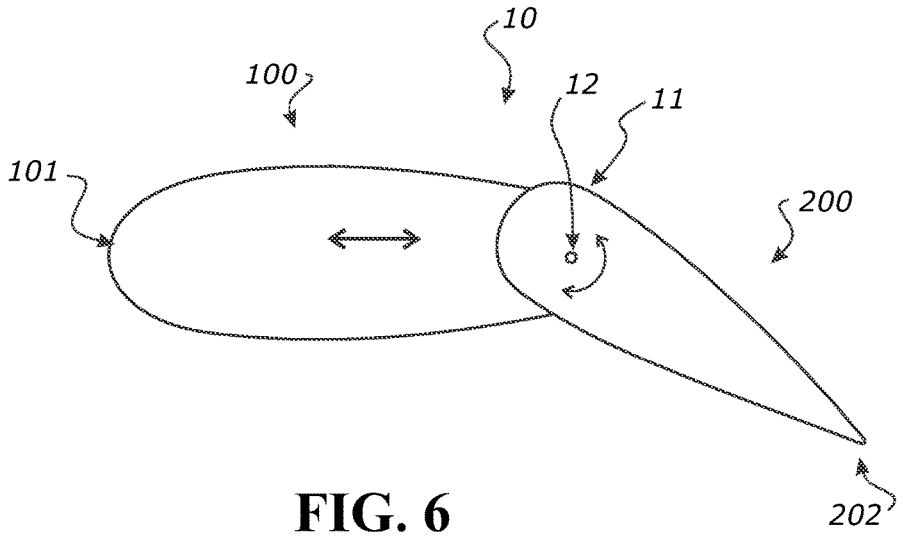

FIG. 6: shows a top schematic view of a wing sail in the extended condition, whereby the moveable section can pivot.

Figure 7A:
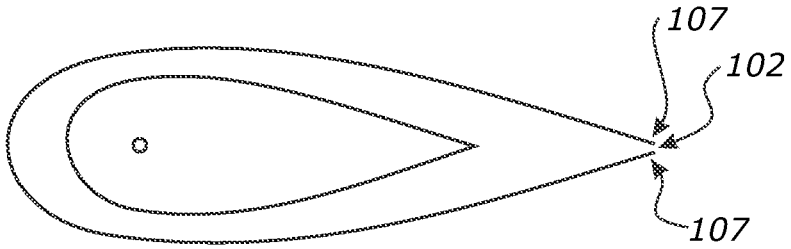

FIG. 7A: shows a top schematic view of a wing sail with the moveable section fully retracted within the primary section.

Figure 7B:
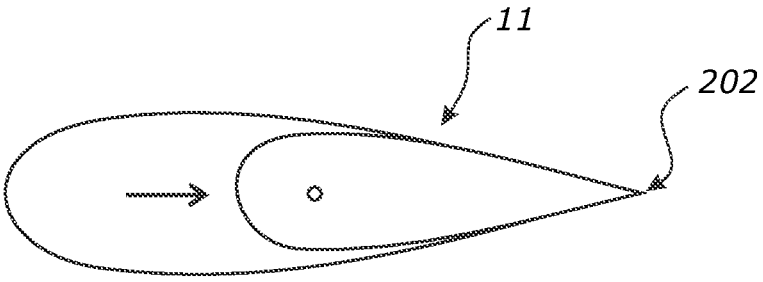

FIG. 7B: shows a top schematic view of a wing sail with the moveable section partially extending out of the fore section.

Figure 7C:
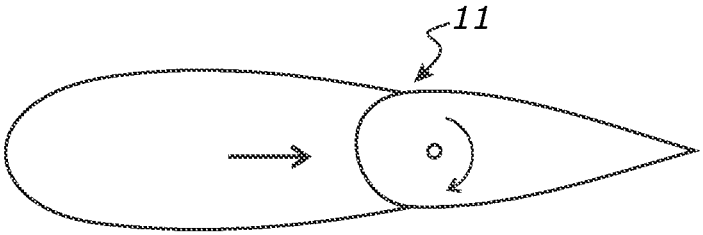

FIG. 7C: shows a top schematic view of a wing sail with the moveable section fully extending from the fore section.

Figure 8:
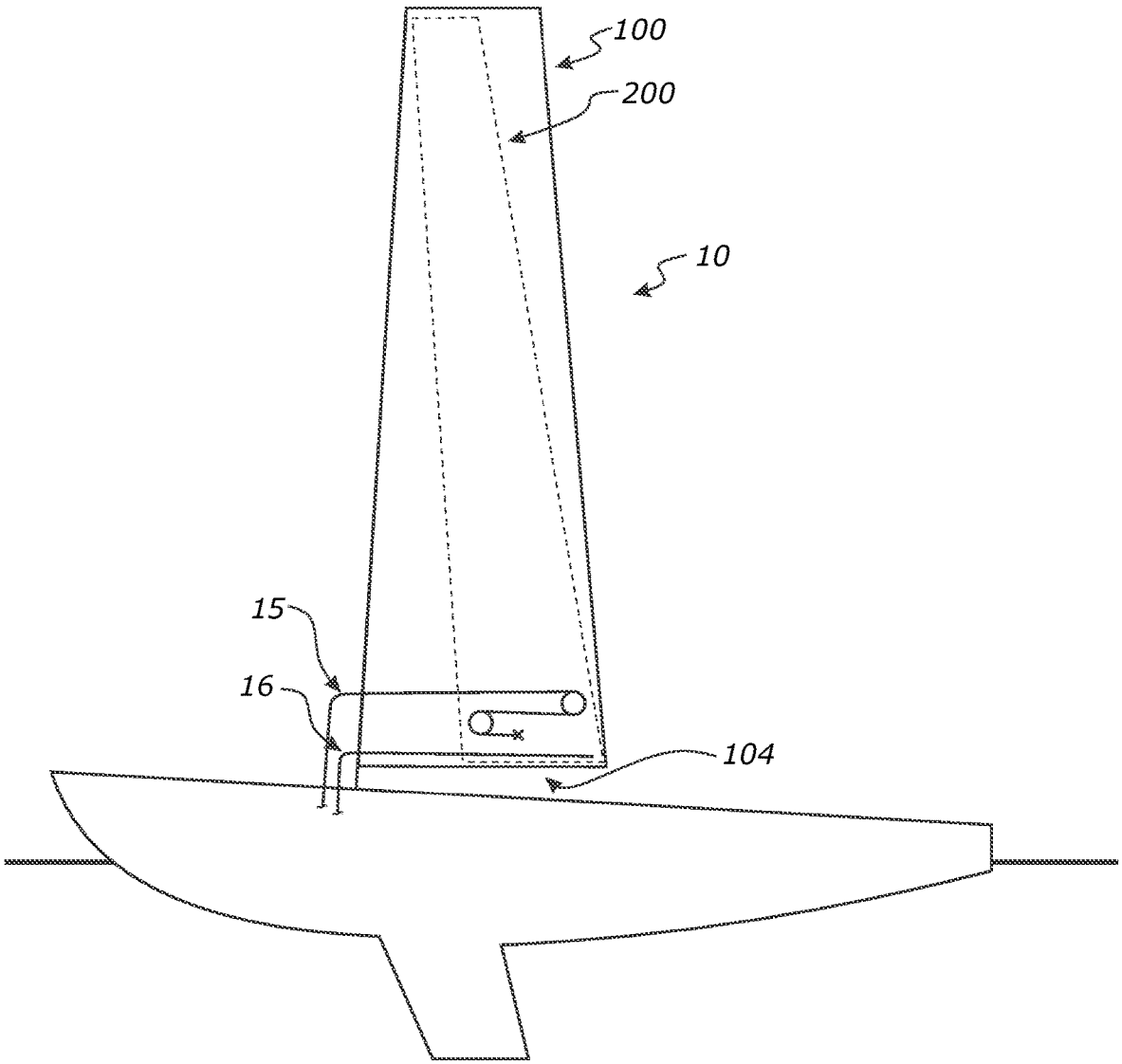

FIG. 8: shows a side schematic view of an alternative wing sail, where the moveable section translates from the fore section.

Figure 9A:
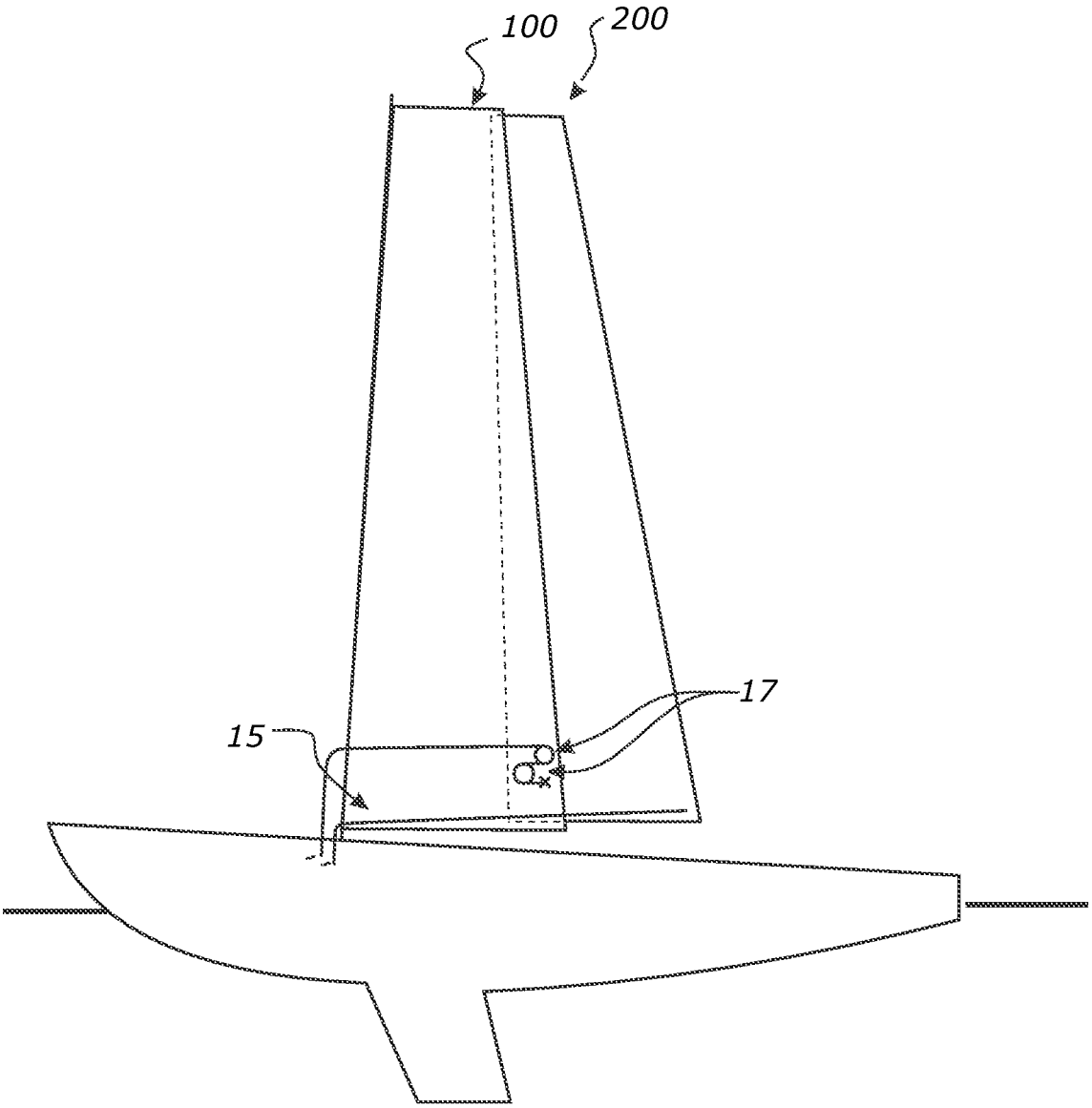

FIG. 9A: shows FIG. 8A extended.

Figure 9B:
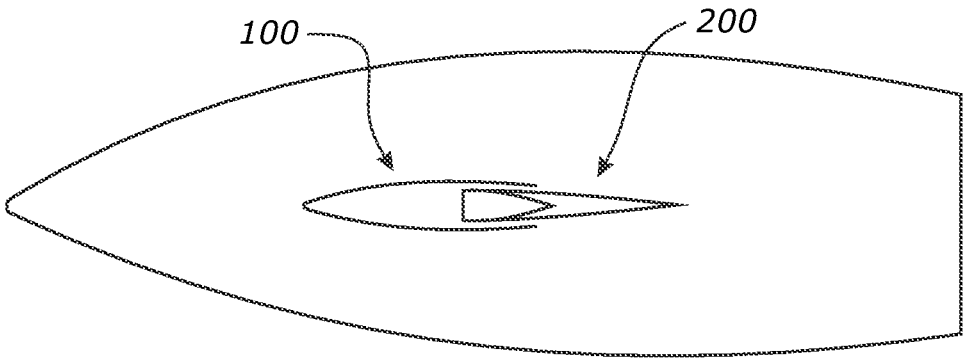

FIG. 9B: shows a top schematic view of a wing sail of FIG. 9A.

Figure 10A:
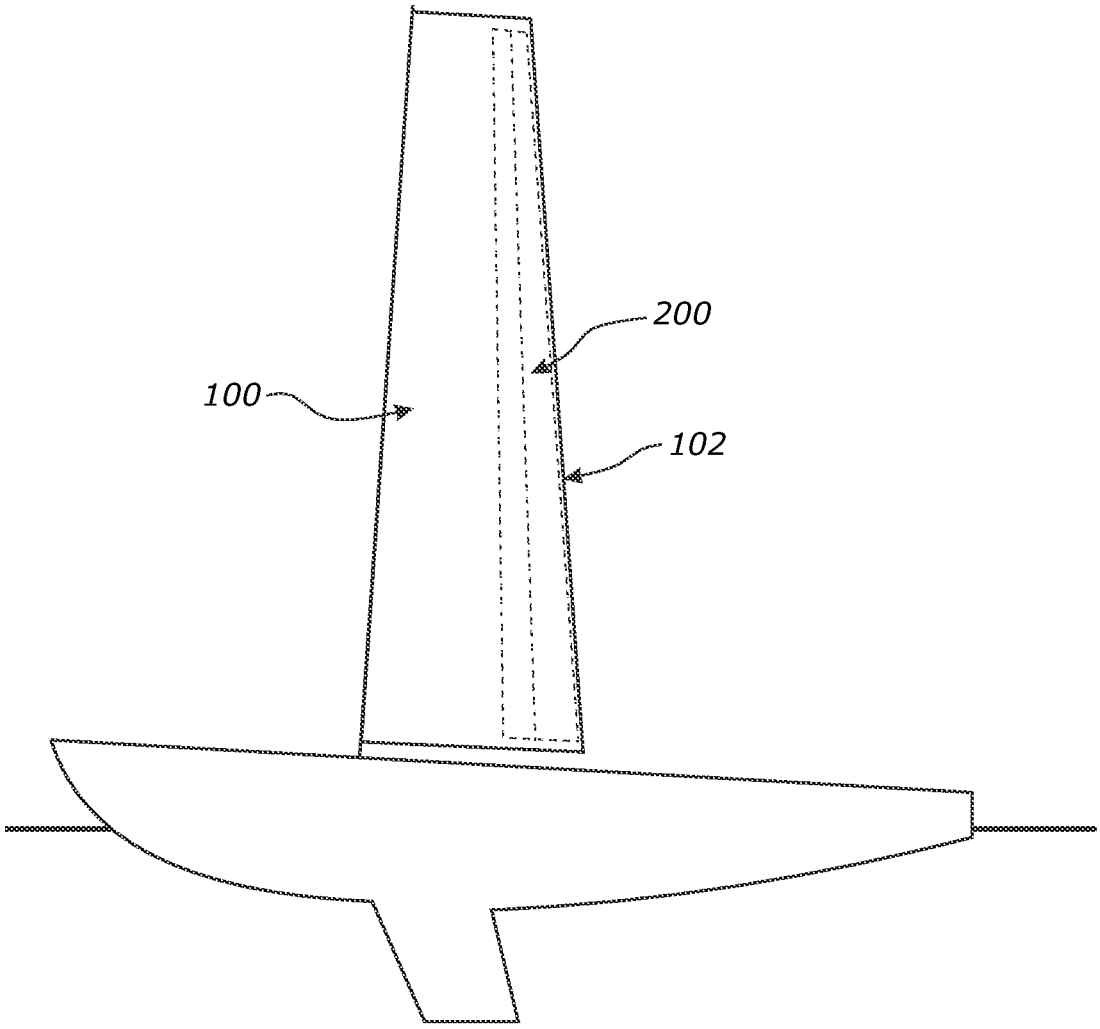

FIG. 10A shows a side schematic view of an alternative embodiment of a nestable wing sail with a furling moveable section.

Figure 10B:
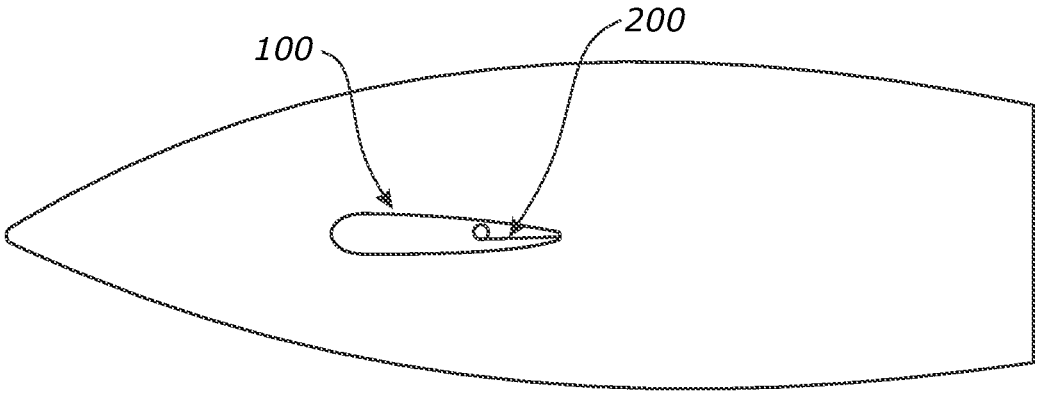

FIG. 10B: shows a top schematic view of FIG. 10A.

Figure 10C:
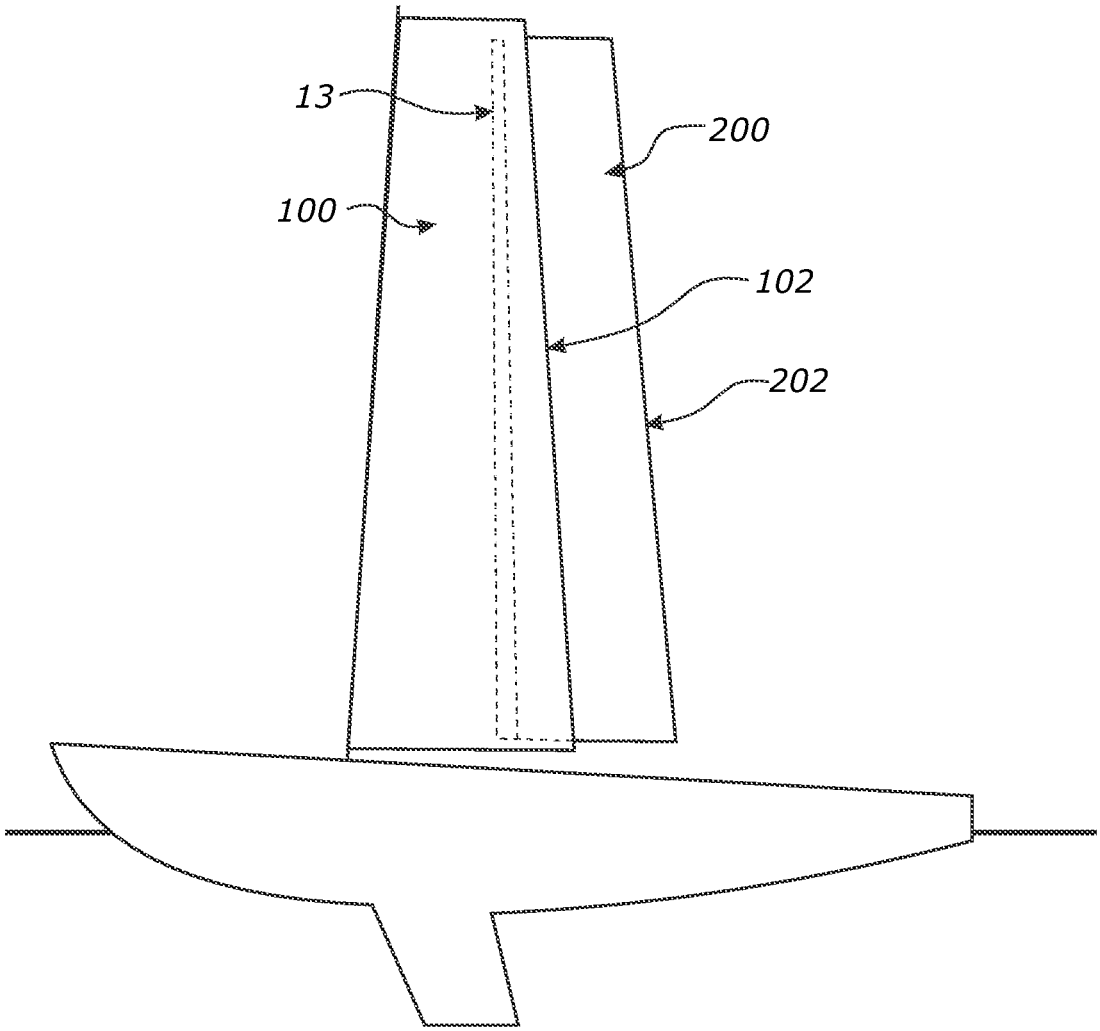

FIG. 10C: shows an extended condition of FIG. 10A.

Figure 10D:
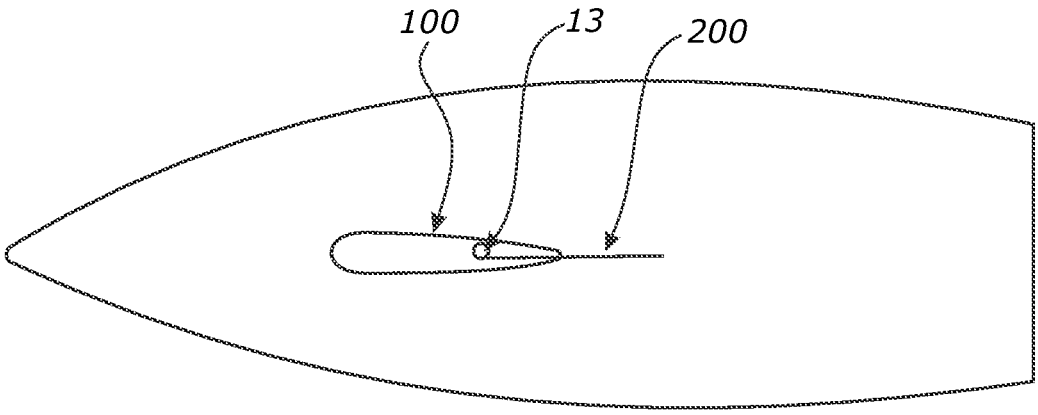

FIG. 10D: shows a top schematic view of FIG. 10C.

Figure 11A:
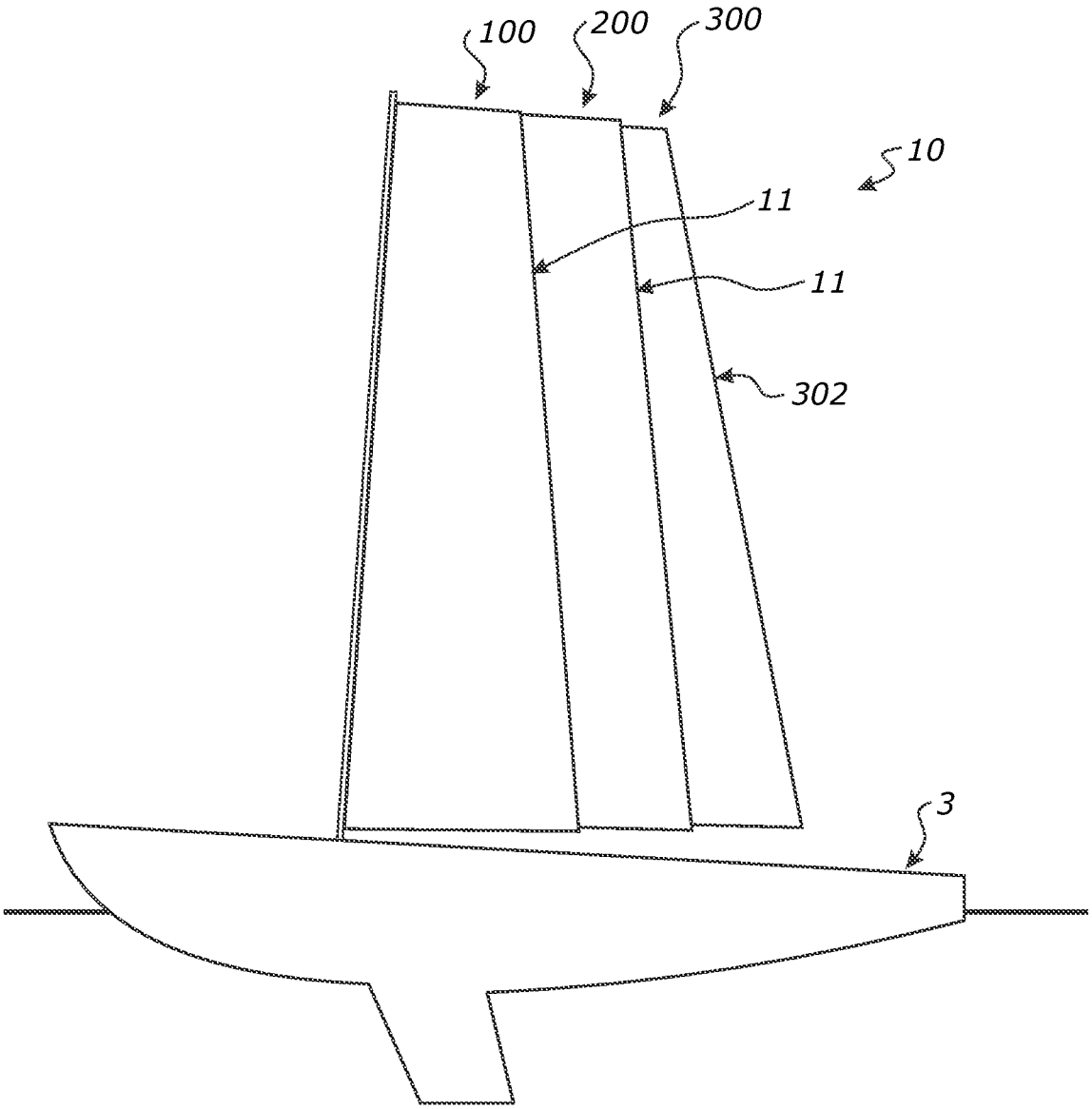

FIG. 11A: shows a side schematic view of a nestable wing sail with two moveable sections.

Figure 11B:
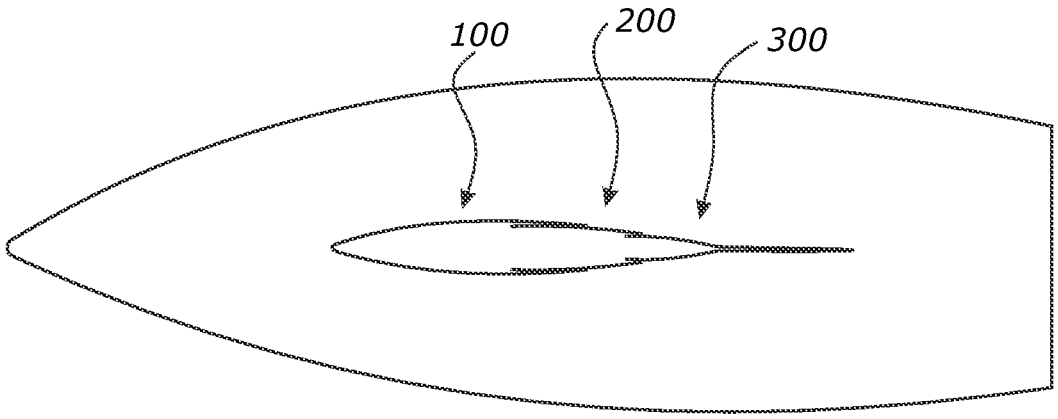

FIG. 11B: shows a top schematic view of FIG. 11A.

Figure 12A:
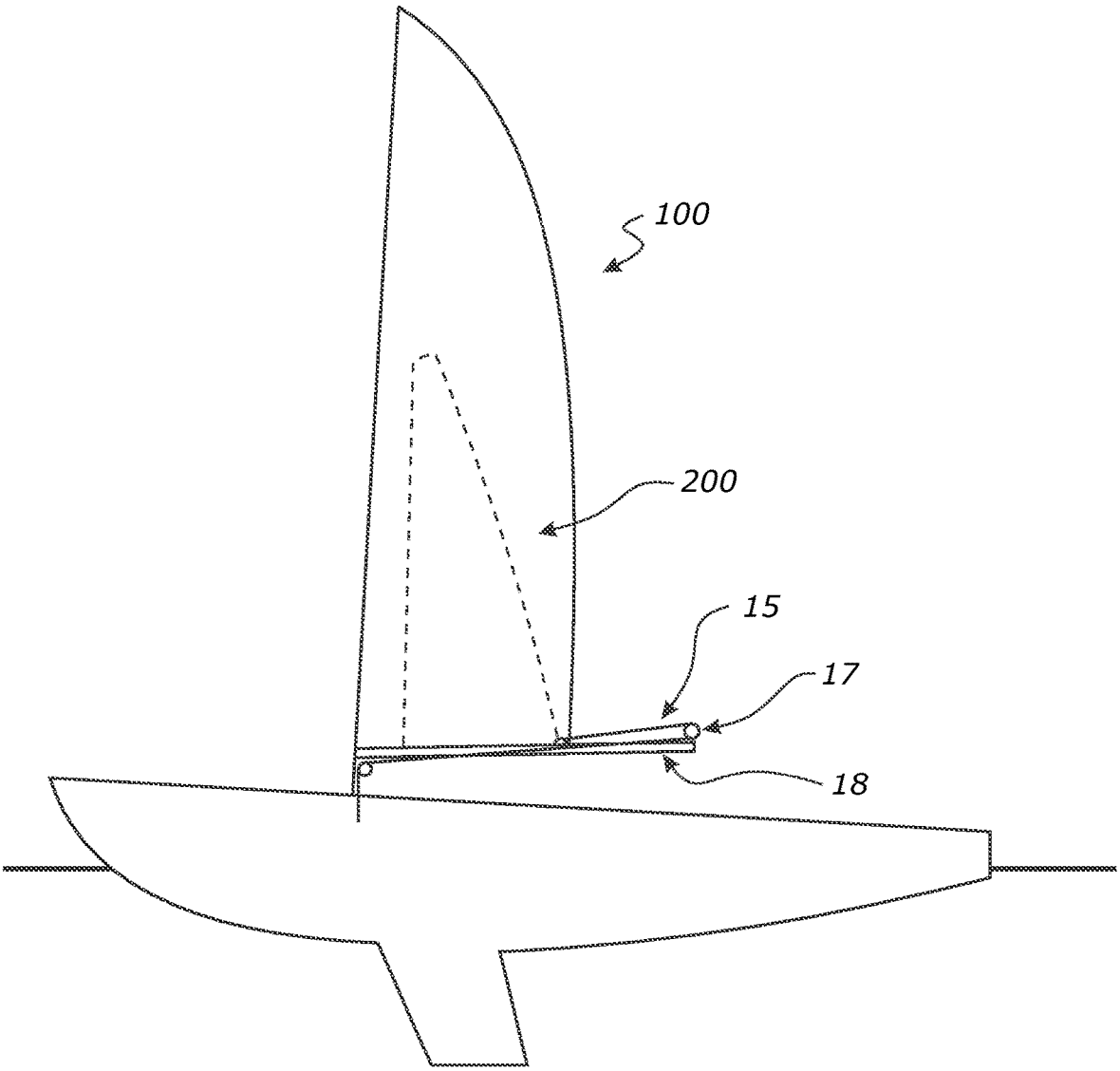

FIG. 12A: shows a side schematic view of a nestable wing sail of an alternative embodiment where the moveable section is actuated out via a sail boom.

Figure 12B:
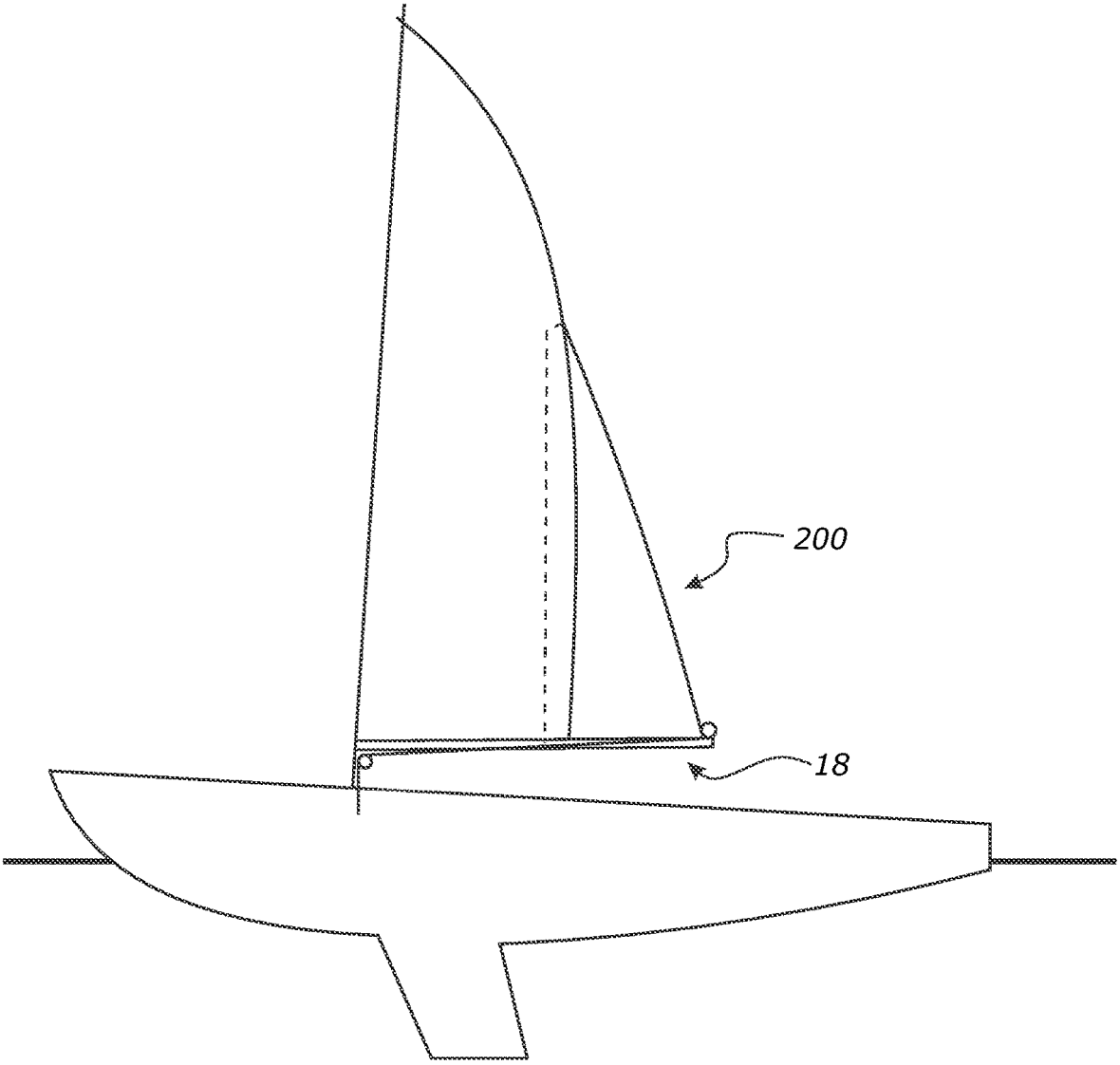

FIG. 12B: shows an extended view of FIG. 12A

Figure 13A:
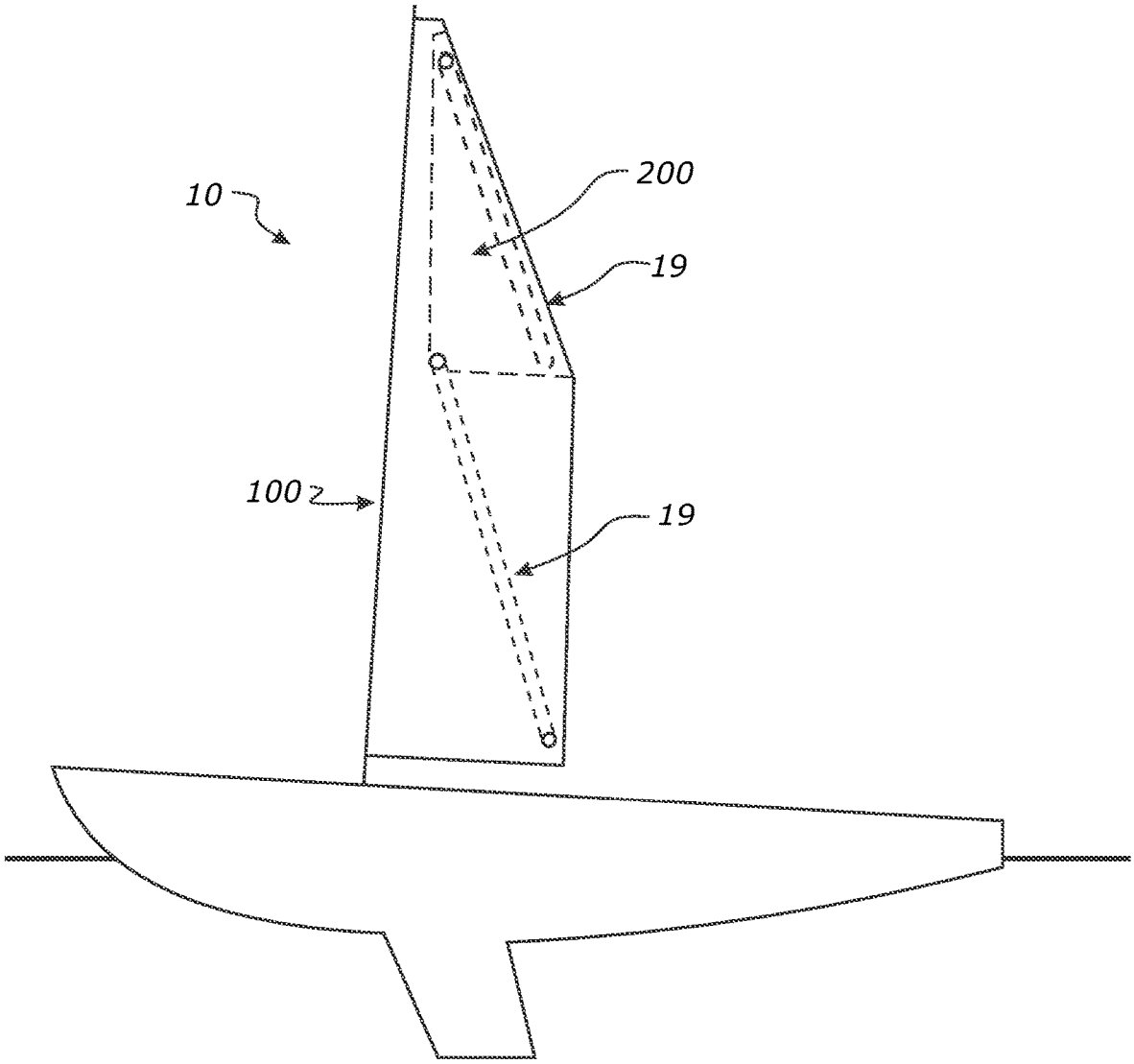

FIG. 13A: shows a side schematic view of a nestable wing sail of an alternative embodiment where the moveable section slides down and aft to its extended condition.

Figure 13B:
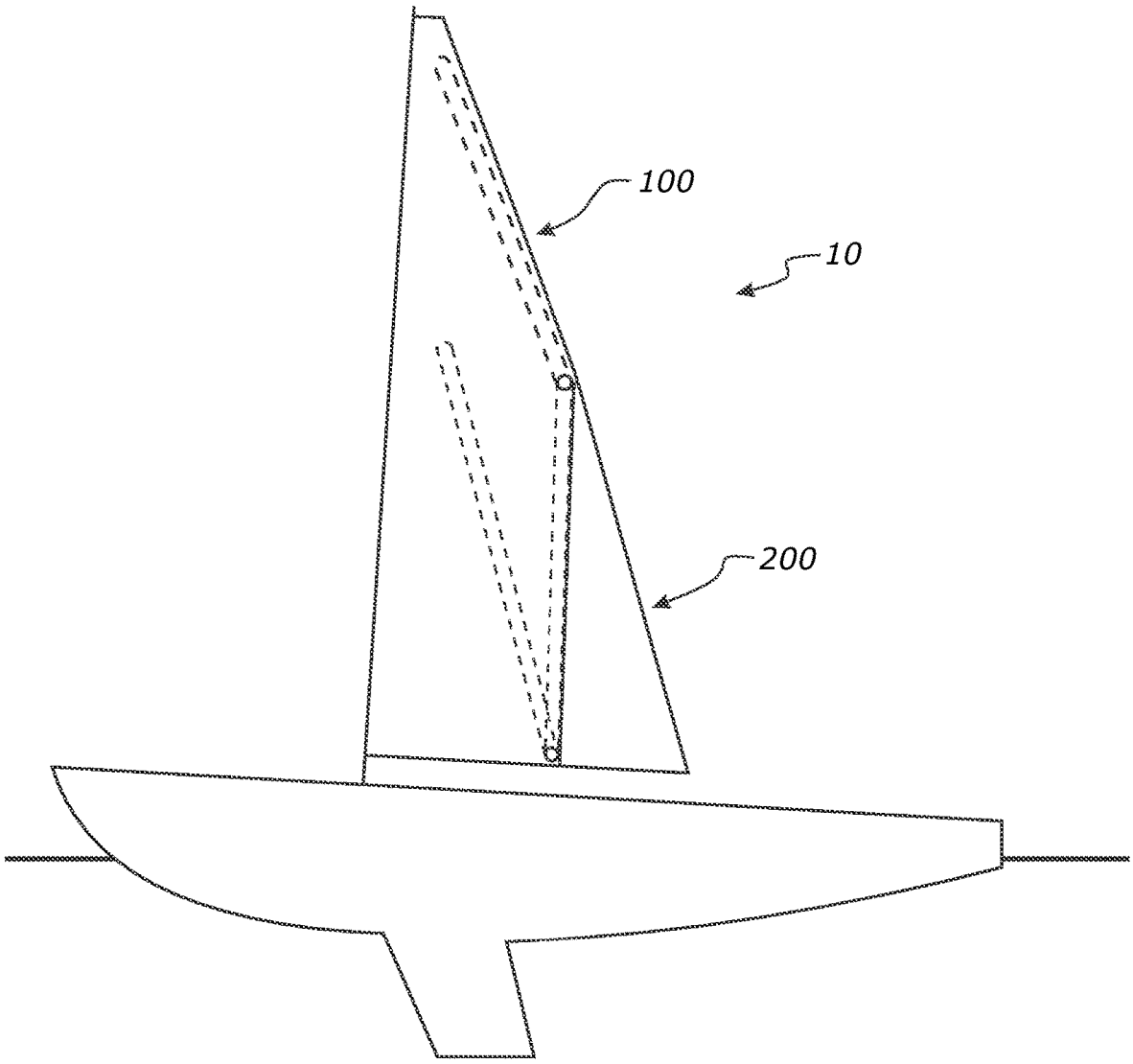

FIG. 13B: shows an extended view of FIG. 13A.

Figure 14A:
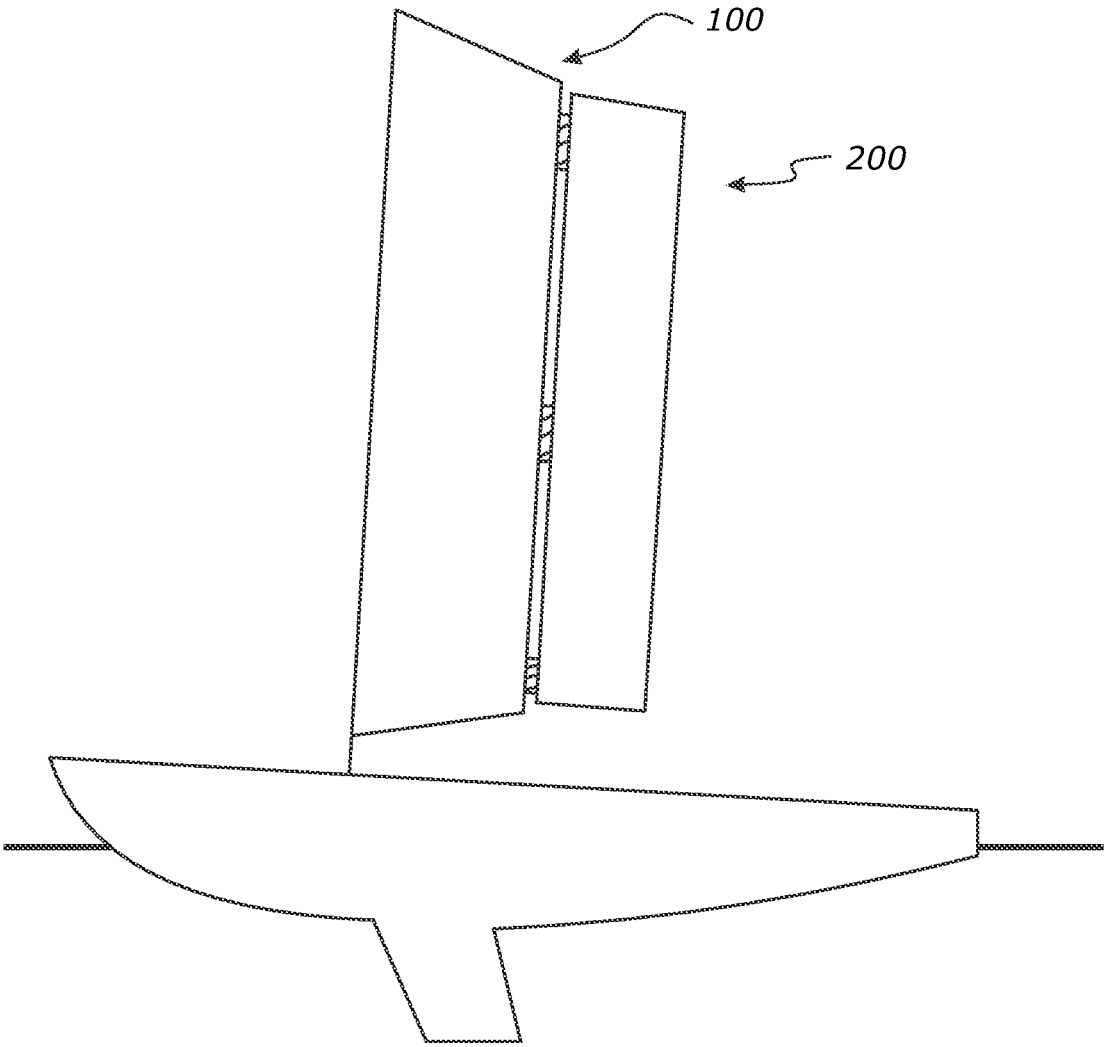

FIG. 14A: shows a side schematic view of a nestable wing sail of an alternative embodiment where the sail has a gap intermediate the moveable section and the primary section.

Figure 14B:
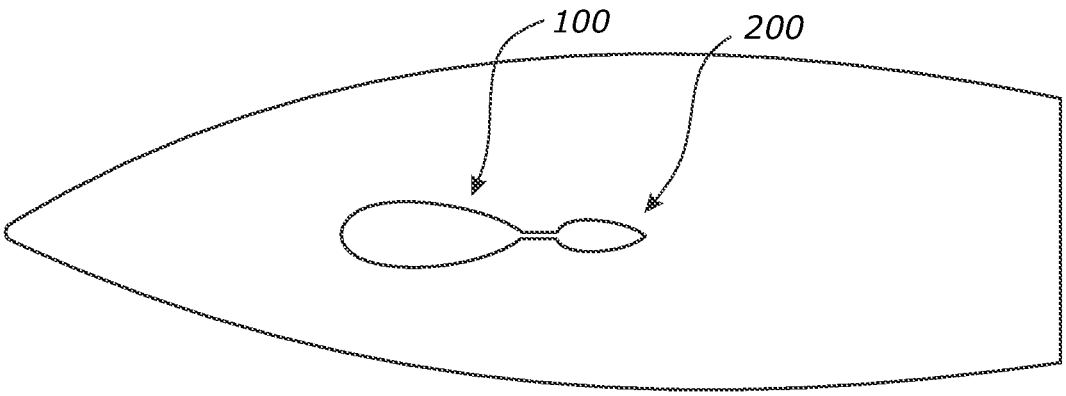

FIG. 14B: shows a top schematic view of 14A.

Figure 14C:
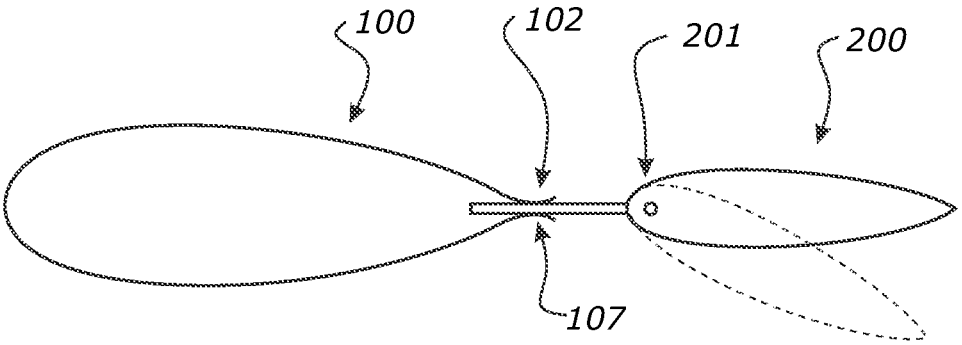
Figure 14D:
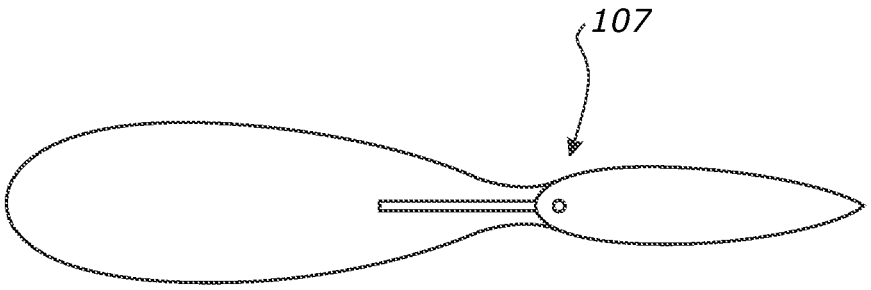
Figure 14E:
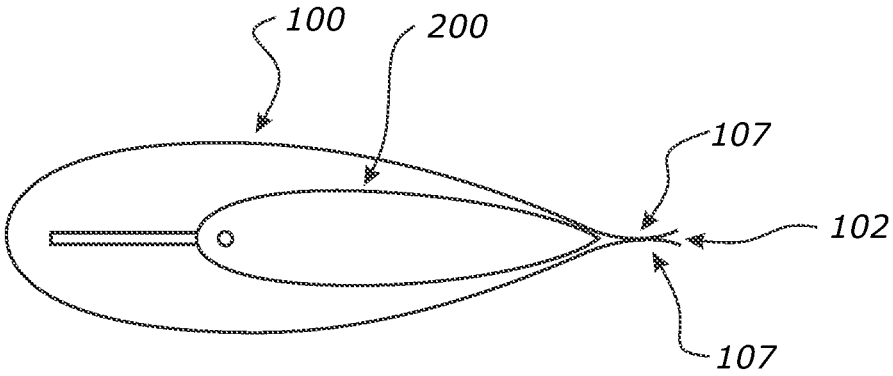

FIG. 14C-E: shows a top schematic view of the sail of FIG. 14A, showing the moveable section retracting into the primary section.

Figure 15A:
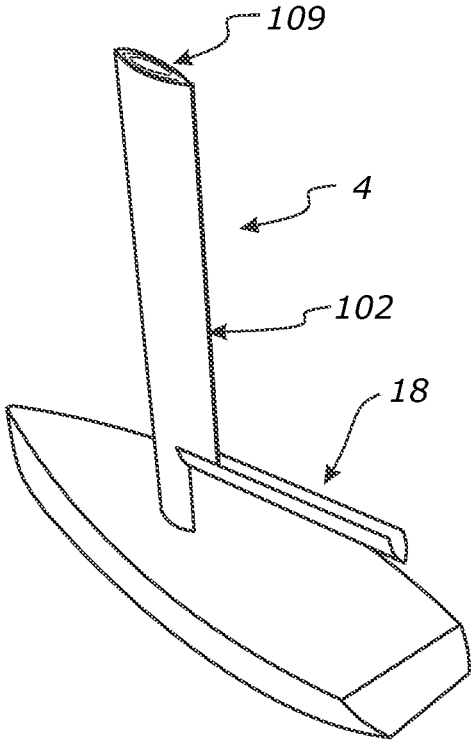
Figure 15B:
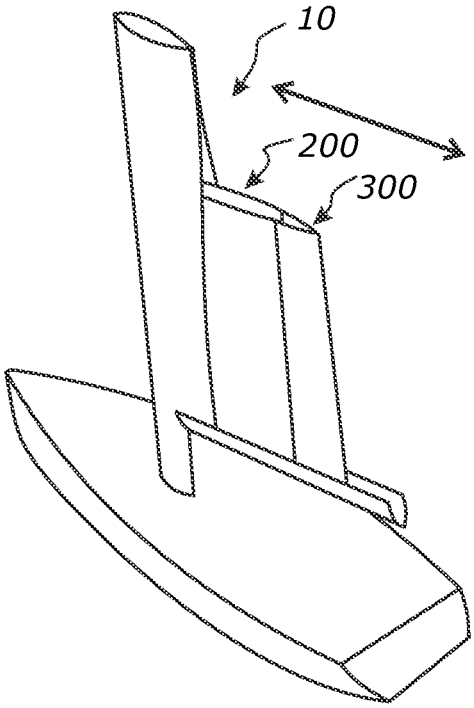
Figure 15C:
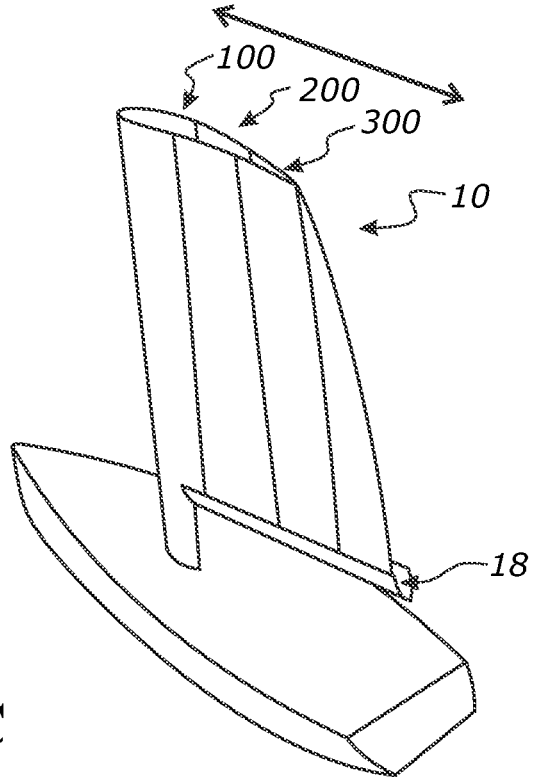

FIG. 15A-C: shows a rear top schematic view of a sail extending from a mast or wing sail.

Figure 16A:
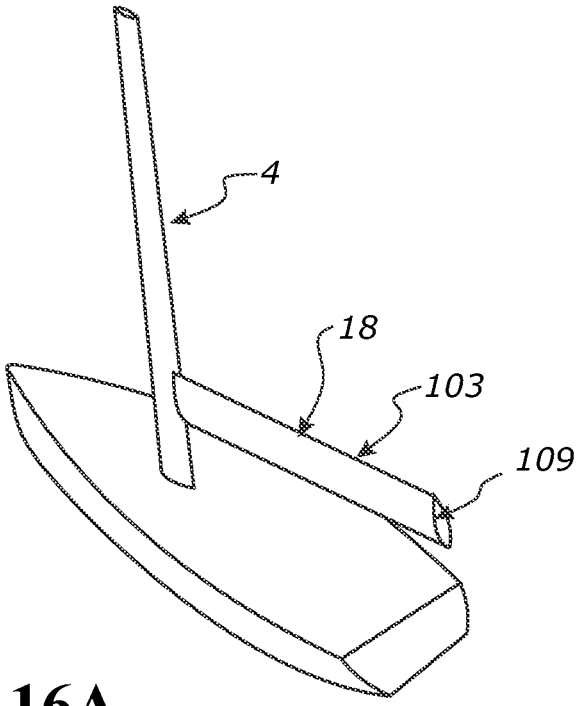
Figure 16B:
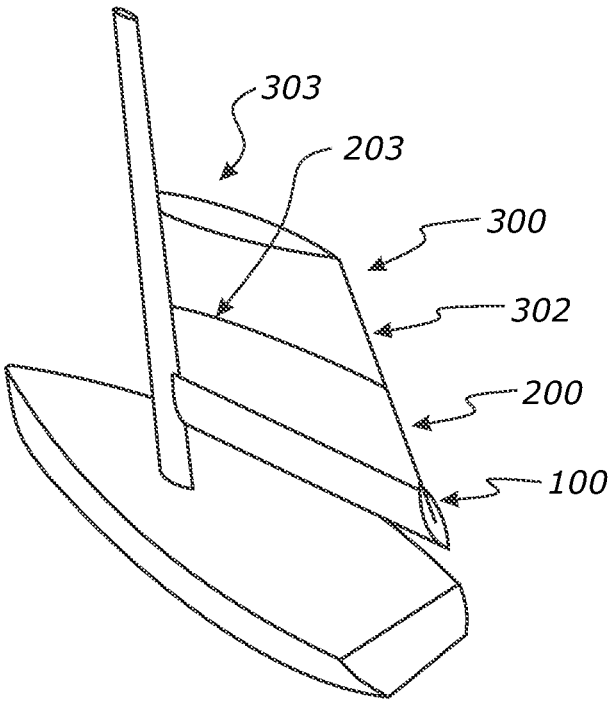
Figure 16C:
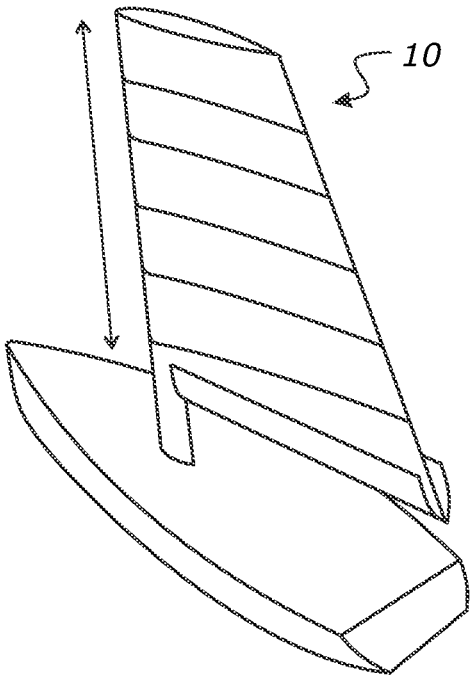

FIG. 16A-C: shows a rear top schematic view of a sail extending from a boom.

DETAILED DESCRIPTION

With reference to the above drawings, in which similar features are generally indicated by similar numerals, a sail according to a first aspect of the invention is generally indicated by the numeral 10.

In one embodiment now described, there is provided a nestable wing sail 10 configured to be used on a yacht 2. The yacht having a hull 3, and the wing sail optionally attached to the hull via a mast 4. Alternatively, the mast may be integral with the wing sail. The wing sail is preferably of an aerofoil shape, and is formed from skins that create the sides of the wing sail, and the surfaces to be the effective sail area. In one embodiment, the wing sail is formed between the mast and a boom.

The sail 10 comprises a primary, or forward section, from which two or more moveable sections are able nest within. The primary section comprises a cavity 109, for the moveable sections to nest. The cavity 109 may be formed within one or more or the wing sail 10, mast 4, and boom. The moveable section can be fully or partially nested within one or more of the wing sail 10, mast 4, and boom 18. The primary section may be said to comprise one or more or the wing sail, mast, and boom. The moveable sections are able to extend out from the cavity 109, and aft through the leech 102. There may be multiple moveable sections able to nest within the primary section. Moveable sections may be described as first, second and third moveable sections and so forth. The primary section 100 (as shown in FIG. 1) houses the moveable sections. The primary section may include the mast 4 and/or boom 18

Moving of the moveable sections aft from the primary section allows the sail 10 to increase its effective sail area. To reduce the sail area, the moveable sections are retracted back into their adjacent and forward sections, from their extended position.

FIG. 3B shows a primary section 100 having a first moveable section 200 extending from the primary section 100 leech 102. The leech 102 is formed from each aft edge 107 of each side 108 of the primary section 100 (as shown in FIG. 3A-B).

In the embodiment shown in FIG. 1A, the first moveable section 200 extends out from the leech 102 about a pivot point 14 located near the head 103 of the primary section 100. As the first moveable section 200 extends aft from the primary section 100, the primary section aft edges 107 becomes a cover or join 11 intermediate the primary section 100 and the first moveable section 200. The leech 202 of the first moveable section 200, then becomes the leech of the sail 10.

Alternatively, the first moveable section 200 (and optionally subsequent movable sections) extend out vertically from the boom 18/head 103/head 103 etc. I.e. the wing 10 can extend vertically up from the boom, and subsequent sections. FIG. 15*a-c* shows an example of this. The head of the boom, moveable section, and/or primary section is preferably flexible to allow nested sections to pass through. Preferably the boom comprises all nested sections in a cavity 109 when the sail is in a retracted position. The boom 18 in one embodiment can take on an aerofoil type shape, either in the first or second condition.

FIG. 1B shows the first moveable section 200 nested within the primary section 100. The leech 102 of the primary section 100 is the leech of the sail 10.

The embodiments shown in FIGS. 1 & 2 are just one embodiment of an extendable nested wing sail. The embodiment shown in FIGS. 1 & 2 shows a rotating moveable section 200. Other embodiments may be used and fall within the scope of invention, such as embodiments shown in FIGS. 8 & 9 where a translating moveable section 200 is used. In further embodiments, such as in FIG. 10, an unfurling moveable section 200 is utilised to extend the surface area of a wing sail. This will be described in further detail later.

There may be multiple extending sections that can be nested within the primary section 100. FIGS. 11A & 11B show a sail with two moveable sections 200 and 300. Again, these moveable sections 200, 300 may translate from the primary section 100, or they may rotate about a pivot point from their adjacent forward section, or both may rotate about the primary section (not shown), or they may utilise a combination or translation and rotation.

FIGS. 3A & 3B show details of a simplified cross section of the embodiment of FIGS. 1 & 2. It can be seen that the aft edges 107 of the leech 102 of the primary section 100 are able to open up to allow the first moveable section 200 to pass therethrough.

FIGS. 4A, 4B & 5 show a perspective view of the embodiment of FIG. 1, and show that the trailing edges 107 or leech 102 of the primary section 100 open up and allow the moveable section 200 to pass through.

FIG. 6 shows an embodiment where the first moveable section or any of the trailing sections are able to trim or rotate with respect to the primary section, and/or their adjacent sections. This allows the wing sail 10 to be better configured for the wind/sailing conditions.

FIGS. 7A-C show a sail 10 that has a nested section that is able to be partially extended out from the primary section 100. This allows a graduation of configurations between a fully retracted and a fully extended condition of the sail 10. This partial extension can be used in any of the embodiments as described herein.

FIGS. 7A-C also show the moveable section 200 being able to pivot about a point 12 to trim the sail. There may be multiple moveable sections that are able to trim. This trimming configuration may be used in any of the embodiments as described herein.

FIGS. 8 & 9 show the retracted and extended configurations of a translating moveable section 200. FIGS. 8 & 9 show a translating nested section 200 that translates from the trailing edge or leech 102 of the primary section 100. An extension mechanism 15 and a retraction mechanism 16 is used to extend and retract the one or moveable sections.

In the most basic form the extension mechanism 15 is a rope or other flexible member, such as wire, in combination with one or more pulleys 17 that allows pulling of a rope at one end to extend the first moveable section 200 from the primary section 100. As shown in FIG. 8, a retraction mechanism 16 is a rope attached to the foot 104 of the moveable section 200, so the moveable section 200 is able to be pulled towards the bow of the boat, to nest inside the primary section 100.

There may be numerous extension and retraction mechanisms configured and designed to allow optimum or desired extension and retraction of the nested sections. An alternative rope and pulley system is shown in FIG. 12A-B, where a boom 18 is utilised to locate a pulley 17 at its distal end. This allows a rope to pull out a moveable section towards the distal end of the boom 18.

There are many other extension and retraction mechanisms that could be utilised with the present invention. Some examples are linear actuators which are, for example, hydraulic or electric powered.

FIGS. 10A-D show a further embodiment of the invention, wherein the nested section 200 is a single "soft" or "2D" sail. The soft moveable section 200 is configured to be unfurled about a roller 13 to extend it outwards from the leech 102. This is a more simplified design, wherein the leech 102 does not need to extend laterally as much to allow the soft moveable section 200 to pass therethrough, compared to a wing moveable section. The soft sail may be stored in said cavity 109 within the mast or boom.

FIGS. 13A-B show a further embodiment, where the moveable section 200 is configured to slide/translate downwards towards its extended condition as shown in FIG. 13B. The moveable section 200 is configured to slide along tracks 19 (not all shown) to move between a retracted and extended condition. This embodiment allows the movable section 200 to be gravity assisted towards its extended condition. A simply halyard system attached to the moveable section 200 may be used to retract the moveable section 200 back into the primary section 100. This is just one embodiment of a tracked system, there may be many different configurations and track patterns appropriate for different sail types, and designs. For example, less steep tracks, tracks that utilise hydraulics to move the moveable sections 200 etc.

FIGS. 14A-E show a further embodiment of the present invention where the aerofoil shape of the moveable section 200 fully extends out of the aerofoil shape of the primary section 100. This configuration allows air flow intermediate the leech 102 and the luff 201 of the moveable section 201. This configuration of a gap seen, often seen intermediate a trim tab and main section is known in existing wing sails. However, this trim tab has not previously been able to be retracted into a forward sail section, or been able have its effective sail area removed from the overall effective sail area.

The moveable section 200 seen in FIG. 14 may be able to pivoted about an axis so as to allow differing wing shapes.

The leech 102 may be configured to allow easy entry of the movable section 200 back in to the primary section 100. FIG. 14C shows the upturned edges of the leech 102 that allow the movable section 200 to start entering into the leech 102. This is required, as in other embodiments where the movable section stays keeps the leech 102 open, in the FIG. 14 embodiment the leech 102 is allowed to close back in on itself. And thus, a configurations such as a upturn at each leech edge is utilised to allow the movable section 200 to start entering into the leech 102

The leech opening, for all embodiments, it may be of a variety of configurations. In one embodiment, the wing sections may have flexible ribs on each side that are configured to flex outwards so that the aft edge of the wing section, at the leech edge 102, able to laterally open up to allow movable sections 200 to enter and exit. Flexible ribs (or battens) are well-known in the sailing industry.

The leech 102 of a section that is able to laterally open up has aft edges 107 as shown in FIG. 3B.

In some embodiments the aft edges 107 are substantially stiff so that they are able to be actuated laterally outwards (independent of the respective moveable section) to allow a movable section to pass therethrough. This is an alternative to the movable section itself opening up the aft edges 107/leech 102 as it passes through. However, in most embodiments, the aft edges that form the leech of a respective section are substantially resilient and flexible so that they follow the outer surface of the respective movable section.

Preferably the aft edges 107 are able to form a join 11 as described previously. This join may include or have an integral flexible member that is compliant with the angles between two adjacent sections. The join ideally creates a smooth transition between the sail sections.

The aft edges 107 may in some embodiments be biased open (i.e. laterally spread apart), with actuation to close the aft edges 107 to form a leech 102, in behind the moveable section once it is fully nested within the section that houses it. However, more likely, is that the aft edges 107 are biased closed, and forced to be spread laterally apart by moveable section passing through.

Where the leech 102 and aft edges 107 and other features of the primary section are described, it is incorporated in the present invention that the moveable sections that have further nested moveable sections within them, may include the same designs, features and configurations of the primary section.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A wing sail for a yacht, the wing sail comprising at least two sail sections, a. a primary section attached, integral with, or comprising a mast, and comprising two skins forming at least part of an aerofoil surface, the primary section further comprising a leech at aft edges of and where the two skins converge, and b. a movable section configured to move between a first condition where the movable section is nested or partially nested within or at the leech of the primary section, and a second condition where the movable section extends at least in part from at least part of the leech from intermediate the two skins, wherein the primary section comprises flexible regions at its leech that are configured to flex to allow the movable section to pass intermediate the sides of the primary section through the primary section leech.

2. The wing sail as claimed in claim 1, wherein the primary section comprises a cavity between the two skins, that can receive the movable section.

3. The wing sail as claimed in claim 1, wherein the primary section and movable section comprise sail area that make up the sail area of the wing sail.

4. The wing sail as claimed in claim 1, wherein in the first condition the movable section is fully nested within the primary section so that the leech of the primary section forms the leech of the sail, and/or the primary section comprises one or more of the mast and a boom.

5. The wing sail as claimed in claim 1, wherein in the second condition the aft edge of the movable section forms at least part of the leech of the sail.

6. The wing sail as claimed in claim 1, wherein the movable section translates with respect to the primary section to move between the first and second condition.

7. The wing sail as claimed in claim 1, wherein the movable section rotates with respect to the primary section to move between the first and second condition.

8. The wing sail as claimed in claim 1, wherein the movable section is at least in part an aerofoil wing sail shape.

9. The wing sail as claimed in claim 1, wherein the aft edges of a sail section form a leech when not spread laterally apart by an adjacent sail section.

10. The wing sail as claimed in claim 9, wherein the aft edges of the primary section overlap with the adjacent section to form a join comprising a substantially continuous surface between the sections adjacent each other when spread apart by the adjacent sail section.

11. The wing sail as claimed in claim 1, wherein the sail comprises the movable section and a second movable section.

12. The wing sail as claimed in claim 11, wherein the second movable section nests within the movable section, in a similar configuration to how the movable section nests within the primary section.

13. A reconfigurable wing sail for a yacht, the wing sail having an adjustable effective sail area by extending or retracting a nested wing sail section through the leech or head of a primary wing sail section, wherein the adjustable effective sail area towards and along the said leech or head of the primary wing sail section is flexible to allow the nested wing sail section to pass therethrough.

14. The reconfigurable wing sail as claimed in claim 13, wherein the nested wing sail section nests within a cavity of the primary wing sail section.

15. The reconfigurable wing sail as claimed in claim 13, wherein the primary wing sail section comprises a mast and/or boom.

16. A yacht comprising a sail, the sail comprising at least two sail sections and a primary section having a cavity intermediate port and starboard face sides which converge to form at a leech or head of the primary section, and at least two movable sections moveable between a first condition where the movable sections are enveloped or partially enveloped in the cavity, and a second condition where at least a portion of at least one movable section extends from the head or leech out of the cavity of the primary section, where in the second condition the movable section adds to the effective sail area of the sail, wherein the head and/or leech of said primary section and/or one or moveable sections is flexible to allow moveable sections to pass through.

17. The yacht as claimed in claim 16, wherein the moveable sections move vertically out of the head primary section that acts as boom, or from move out from the leech of a mast or wing sail.

18. The yacht as claimed in claim 16, wherein the primary section forms at least part of an aerofoil wing shape in either one or both of the first and second condition.

* * * * *